United States Patent [19]

Onoda

[11] Patent Number: 4,667,451

[45] Date of Patent: May 26, 1987

[54] COLLAPSIBLE TRUSS UNIT, AND FRAMEWORKS CONSTRUCTED BY COMBINATIONS OF SUCH UNITS

[75] Inventor: Junjiro Onoda, 1986-10, Kanai-Machi, Machida-Shi, Tokyo-To, Japan

[73] Assignees: Fuji Jukogyo Kabushiki Kaisha; Junjiro Onoda, both of Tokyo, Japan

[21] Appl. No.: 884,444

[22] Filed: Jul. 11, 1986

[30] Foreign Application Priority Data

Jul. 25, 1985 [JP] Japan ..... 60-164716

[51] Int. Cl.[4] ..... E04H 12/18

[52] U.S. Cl. ..... 52/646; 52/111; 52/632

[58] Field of Search ..... 52/645, 646, 108, 111, 52/632; 343/871, 915; 135/104–109

[56] References Cited

U.S. PATENT DOCUMENTS

| | | | |
|---|---|---|---|
| 3,486,279 | 12/1969 | Webb | 52/646 X |
| 4,475,323 | 10/1984 | Schwartzberg et al. | 52/645 X |
| 4,578,919 | 4/1986 | Amadon et al. | 52/645 |
| 4,587,777 | 5/1986 | Vasques et al. | 52/645 X |

FOREIGN PATENT DOCUMENTS

| | | | |
|---|---|---|---|
| WO85/02434 | 6/1985 | PCT Int'l Appl. | 52/646 |

OTHER PUBLICATIONS

Development of Deployable Structures for Large Space Platform Systems Interim Report, vol. 1, NASA/MSFC Contract NAS8-34677, pp. 1-34, 1-36, 1-37, 1-38, 1-39, 1-68, Aug. 1982.

*Primary Examiner*—J. Karl Bell

*Attorney, Agent, or Firm*—Martin A. Farber

[57] ABSTRACT

A collapsible, or deployable, truss unit to be combined with a multiplicity of other similar units in an array for the construction of, for example, medium to large size frameworks in outer space. Each truss unit comprises two substantially rectangular arrangements of four rigid side members pivotally joined to one another, to be directed toward the opposite sides of the framework constructed, and four rigid cross members extending between the joints of the two rectangular arrangements of the side members. A flexible brace or braces are arranged diagonally of each rectangular arrangement of the side members. Two diagonally opposite ones of the four cross members have each a hinge assembly mounted thereto for longitudinal displacement. Each movable hinge assembly has two rigid diagonal members pivoted thereto each at one end, the other ends of the diagonal members being pivoted to two diagonally opposite ones of the four joints of one rectangular arrangement of side members. So constructed, the truss units can be each compactly held together during transportion and can be readily deployed into cubic or like shape in place of assemblage.

10 Claims, 16 Drawing Figures

COLLAPSIBLE TRUSS UNIT, AND FRAMEWORKS CONSTRUCTED BY COMBINATIONS OF SUCH UNITS

BACKGROUND OF THE INVENTION

This invention relates to the novel configuration of a collapsible, or deployable, truss unit and to frameworks composed of a plurality or multiplicity of such truss units joined together in a series or in rows and columns. The truss units in accordance with the invention are well suited for the construction of medium to large scale structures in outer space, as well as of temporary or emergency structures on the earth, among other applications.

With the rapid development in recent years of space technology, the exploration and utilization of outer space is becoming, and to a certain extent has become, a matter of reality. Space engineers envisage such structures in orbit as space colonies, space stations, solar power plants, huge antennas, etc. All the building materials for such orbiting structures must of course be transported from the earth. Thus the building materials for space use must meet the following requirements:

1. Maximum possible lightness.
2. Smallness in size—small enough to be loaded on launch vehicles or space shuttles.
3. Ability to be closely packed together during transportions.
4. Ease of construction or assemblage in space.
5. High rigidity of the framework constructed.

Many space specialits agree that trusses fulfill all these requirements and are the most promising building materials for the frameworks of large space constructions. Nestable columns are an example of such building materials heretofore suggested, with an emphasis on compactness during transportation. However, supposedly, it will be no easy task to construct any desired structure in space from such discrete truss members. Construction work may be automated and done by robots but may still demand human assistance, even at the risk of life.

Deployable truss structures represent a solution to this problem. Even though they cannot possibly be nested so compactly as the individual truss members during shipment, the deployable truss structures can be automatically or semiautomatically unfolded into shape in space. Several such truss structures are known, most of them being extensible in one direction only. An example is found in Japanese Patent Publication No. 49-26653. This and other similar conventional truss structures are collapsed by bending some constituent members in the middle.

Two dimensionally deployable trusses have also been suggested, an example being disclosed in "Status of Deployable GEO-TRUSS Development" by J. A. Fager in NASA CP-2269 Part 1, "Large Space Antenna Systems Technology", published 1982. The "Geo-Trusses" when deployed make up a planar or curved array of approximately regular tetrahedral units and approximately regular octahedral units. For collapsing this structure, all the truss members on its opposite surfaces must be bent in the middle.

SUMMARY OF THE INVENTION

The present invention proposes an improved truss unit construction which requires the bending of no, or in some cases only a minimum number of, its constituent members for collapsing into a compact bulk and which lends itself to ready deployment with little or no human assistance. The invention also suggests various assemblages of a plurality or multiplicity of such improved truss units in either planar or curved arrays or in either straight or curved rows.

The improved truss unit of this invention may be summarized as comprising a substantially rectangular arrangement of first, second, third and fourth rigid side members pivotally joined to one another to provide first, second, third and fourth joints, and another substantially rectangular arrangement of fifth, sixth, seventh and eighth rigid side members pivotally joined to one another to provide fifth, sixth, seventh and eighth joints. First flexible brace means is arranged diagonally of the rectangular arrangement of the first, second, third and fourth side members, and second flexible brace means is arranged diagonally of the rectangular arrangement of the fifth, six, seventh and eighth side members. First, second, third and fourth rigid cross members extend between, and are pivotally joined to, the first and fifth, the second and sixth, the third and seventh, and the fourth and eighth joints, respectively, of the two rectangular arrangements of the first to fourth, and the fifth to eighth, side members. First and second movable hinge assemblies are mounted to the first and third cross members, respectively, for movement along the same. Also included are a first rigid diagonal member extending between, and pivotally joined to, the first movable hinge assembly and the sixth joint, a second rigid diagonal member extending between, and pivotally joined to, the second movable hinge assembly and the sixth joint, a third rigid diagonal member extending between, and pivotally joined to, the second movable hinge assembly and the eighth joint, and a fourth rigid diagonal member extending between, and pivotally joined to, the first movable hinge assembly and the eighth joint.

When deployed, the truss unit of the above improved configuration takes a more or less boxlike shape, with the first and second movable hinge assemblies held against the first and third joints, respectively. The truss unit is collapsible into a compact, slender mass, with the truss members held approximately parallel to each other, upon movement of the hinge assemblies away from the first and third joints to the fifth and seventh joints, respectively.

In one preferred embodiment each of the first and second flexible brace means takes the form of two ropes, or equivalent means, arranged crosswise with respect to each other and diagonally of each rectangular arrangement of the four side members. The ropes are held in tension when the truss unit is deployed, and slacken upon collapse of the unit. Therefore, in this embodiment, all the rigid members of the truss unit are neither bent, extended or contracted for the collapsing and deployment of the unit, all that is required being to move the hinge assemblies along the two cross members. Such truss members can be of lightweight, high strength construction. It should also be appreciated that the number of articulate joints is reduced to a minimum.

Possibly, however, the use of such ropes in tension might be undesirable from the standpoints of expected lifetime in outer space or of the preloading of the unit. Then each rope may be replaced by a rigid brace member bendable in the middle, as in another embodiment disclosed herein. Further, as in yet another embodiment also disclosed herein, each crosswise arrangement of two ropes may be replaced by a single rigid brace member which also is bendable in the middle but which can further be locked in its unbent state and unlocked for bending. The truss units according to these additional embodiments require the bending of two or four rigid members. The two bendable rigid members, in particular, are far less in number than those of the prior art employing no rope or the like. Both of these additional embodiments possess additional advantages over the prior art in having reduced numbers of articulate joints, locking mechanisms, and drive linkages.

Another aspect of this invention resides in a framework constructed from a plurality or multiplicity of such collapsible truss units. The truss units may be arranged either in a single row or in rows and columns. In either case it is recommended that the first to fourth side members of each truss unit be directed toward one side, and the fifth to eighth side members thereof toward the other side, of the framework.

In a framework composed of an array of the truss units in accordance with the invention, each movable hinge assembly can be shared by four neighboring truss units. That is to say that the framework can be deployed or collapsed by actuating approximately ½ hinge assembly for each truss unit on an average. Consequently, the number of drive linkages required for a given number of the truss units can be remarkably less than those of the comparable prior art. This advantage will become particularly pronounced if a motor drive is employed.

Each movable hinge assembly is shared by two truss units in a framework having a single row of the truss units in accordance with the invention. One movable hinge assembly is thus required for each truss unit. The resulting number of drive linkages is nevertheless smaller than those of the conventional truss structures arranged in one direction.

The above and other features and advantages of this invention and the manner of realizing them will become more apparent, and the invention itself will best be understood, from a study of the following description and appended claims, with reference had to the attached drawings showing some preferable embodiments of the invention.

DESCRIPTION OF THE PREFERRED EMBODIMENTS

Figure 1:
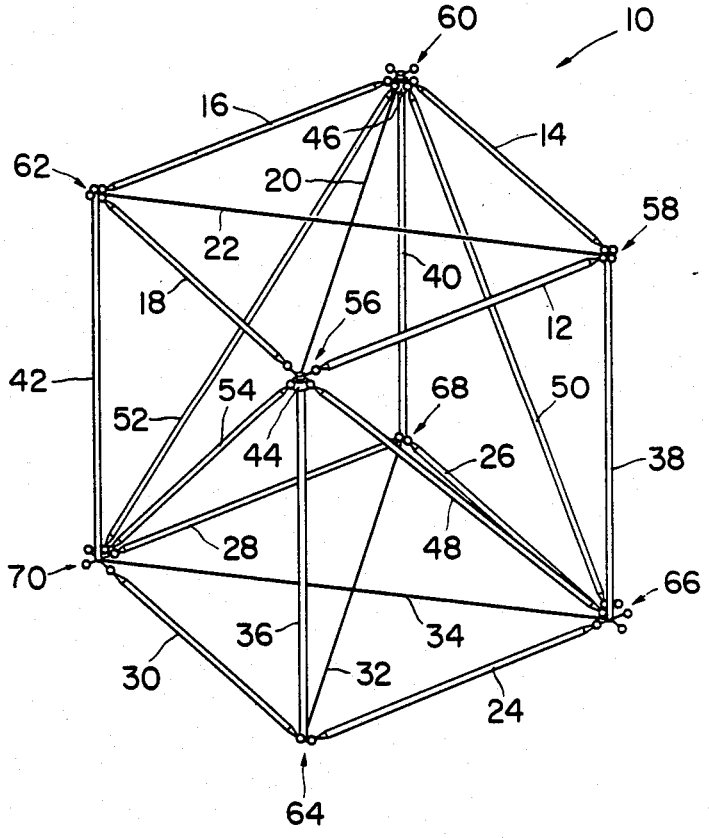
FIG. 1 shows in perspective the collapsible truss unit constructed in accordance with the novel concepts of this invention, the truss unit being herein shown fully deployed.
Figure 2:
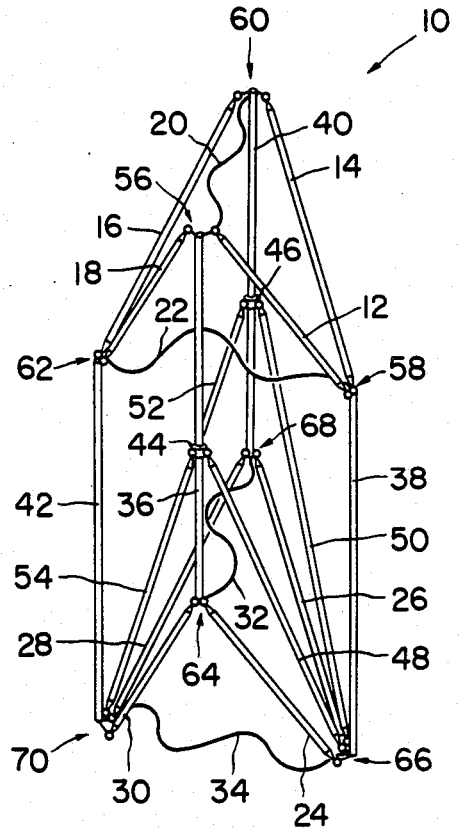
FIG. 2 shows in perspective the truss unit of FIG. 1 being collapsed.

The invention will now be described in detail in terms of the first embodiment thereof illustrated in FIGS. 1 and 2. Generally designated 10, the representative truss unit comprises:

1. a rectangular arrangement of first, second, third and fourth rigid, elongate members 12, 14, 16 and 18 pivotally joined to one another (The pivotal connections are shown as blank dots in both FIGS. 1 and 2, as well as in the subsequent drawings, for the simplicity of illustration.);

2. first flexible brace means herein shown as two ropes or cords 20 and 22 arranged crosswise with respect to each other and diagonally of the rectangular arrangement of the first to fourth rigid members 12, 14, 16 and 18;

3. another rectangular arrangement of fifth, sixth, seventh and eighth rigid, elongate members 24, 26, 28 and 30 pivotally joined to one another;

4. second flexible brace means herein shown as two other ropes or cords 32 and 34 arranged crosswise with respect to each other and diagonally of the rectangular arrangement of the fifth, sixth, seventh and eighth rigid members 24, 26, 28 and 30;

5. a parallel set of first, second, third and fourth rigid, elongate members 36, 38, 40 and 42 extending between, and pivotally joined to, the two rectangular arrangements of the first to fourth, and the fifth to eighth, rigid members;

6. first and second movable hinge assemblies 44 and 46 mounted to the first and third parallel rigid members 36 and 40, respectively, for longitudinal sliding movement thereon; and 7. first, second, third and fourth rigid, elongate diagonal members 48, 50, 52 and 54 extending between, and pivotally joined to, the two movable hinge assemblies and the rectangular arrangement of the fifth to eighth rigid members 24, 26, 28 and 30.

In the use of this and other similar truss units for the construction of a desired framework, each truss unit is to be disposed with its two rectangular arrangements of the first to fourth, and the fifth to eighth, rigid members directed toward the opposite side of the framework, as will be later discussed in detail. Therefore, in this specification and in the claims appended hereto, the first to fourth, and the fifth to eighth, rigid members are referred to as the side members, and the four parallel members 36, 38, 40 and 42 as the cross members.

The pivotal connections of the first to fourth side members 12, 14, 16 and 18 provide first (between 12 and 18), second (between 12 and 14), third (between 14 and 16), and fourth (between 16 and 18) articulate joints 56, 58, 60 and 62. The pivotal connections of the fifth to eighth side members 24, 26, 28 and 30 likewise provide fifth (between 24 and 30), sixth (between 24 and 26), seventh (between 26 and 28), and eighth (between 28 and 30) articulate joints 64, 66, 68 and 70.

The first bracing rope 20 extends between the first and third joints 56 and 60, and the second bracing rope 22 between the second and fourth joints 58 and 60, under pretension. The term "rope" will be used hereinafter in this specification and in the claims appended hereto to mean any such elongate, flexible member. Similarly, the third rope 32 extends between the fifth and seventh joints 64 and 68, and the fourth rope 34 between the sixth and eighth joints 66 and 70, under pretension.

The first cross member 36 extends between the first and fifth joints 56 and 64, the second cross member 38 between the second and sixth joints 58 and 66, the third cross member 40 between the third and seventh joints 60 and 68, and the fourth cross member 42 between the fourth and eighth joints 62 and 70.

The first diagonal member 48 extends between the first movable hinge assembly 44 and the sixth joint 66, the second diagonal member 50 between the second movable hinge assembly 46 and the sixth joint 66, the third diagonal member 52 between the second movable hinge assembly 46 and the eighth joint 70, and the fourth diagonal member 54 between the first movable hinge assembly 44 and the eighth joint 70.

When the truss unit 10 is fully deployed as shown in FIG. 1, the first and second movable hinge assemblies 44 and 46 are held against the first and third joints 56 and 60, respectively. Means (not shown) are provided for locking the movable hinge assemblies 44 and 46 against movement in these positions, in order to hold the truss unit 10 deployed. For collapsing the truss unit 10 the movable hinge assemblies 44 and 46 are unlocked and moved away from the first and third joints 56 and 60 toward the fifth and seventh joints 64 and 68, respectively, as illustrated in FIG. 2. Then the various truss members will pivot at their joints until all the truss members become substantially parallel to one another and become a compact, slender body. It may be noted that the four cross members 36, 38, 40 and 42 maintain their parallel relationship throughout the folding, as well as unfolding, process. This means that the movement of the truss unit 10 during the folding and unfolding processes is simple and reasonable from the viewpoint of dynamics.

The first and second movable hinge assemblies 44 and 46 are identical in construction, so that only the first movable hinge assembly 44 will be described in detail with reference to FIG. 3. The hinge assembly 44 has a sleeve 100 fitted on the first cross member 36 in a manner slidable therealong. The sleeve 100 is provided integrally on the outer surface thereof brackets 102 serving to pivotally connect one ends of the first and fourth diagonal members 48 and 54 by means of pivot pins 104.

On one axial end of the sleeve 100 there are fixed a pair of lugs 106 to which one ends of driving wires 108 are connected respectively. On the other axial end of the sleeve 100 there are also fixed a pair of lugs 110 to which the other ends of the driving wires 108 are connected respectively. These wires 108 are passed around pulleys 112 and 114 which will be described later.

Figure 4:
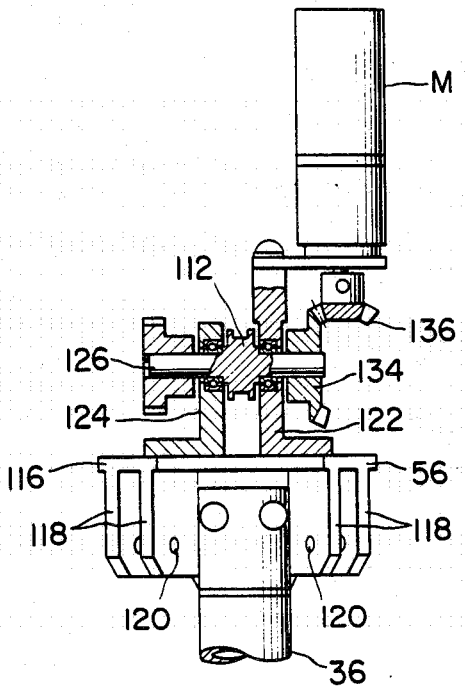

Referring to FIG. 4, the first cross member 36 supports a mount 116 fixed to one end thereof and constituting a part of the first articulate joint 56. The mount 116 is integrally formed therewith brackets 118 which have holes 120 through which pivot pins are passed to pivotally join one ends of the first and fourth side members 12 and 18.

Figure 5:
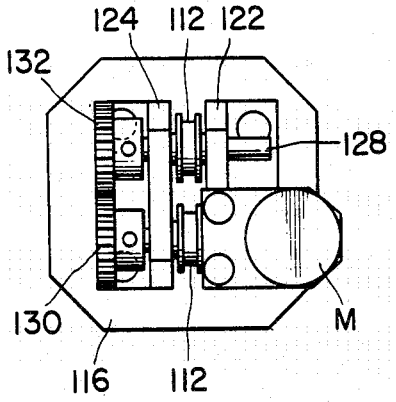
FIGS. 4, 5 and 6 are a front view, partly in section, a plan view and a side view, respectively, of a motor drive means for the movable hinge assembly.
Figure 6:
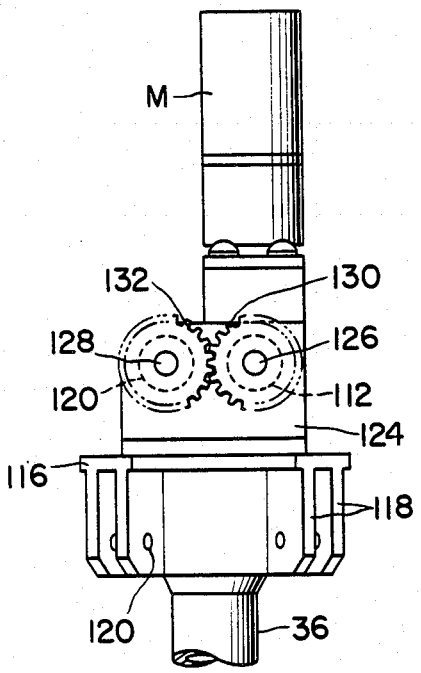

The mount 116 carries thereon upstanding walls 122 and 124 by which a pair of parallel shafts 126 and 128 are rotatably supported as also shown in FIGS. 5 and 6. Spur gears 130 and 132 are fixedly mounted on one ends of the shafts 126 and 128, respectively, so as to mesh with each other. The shafts 126 and 128 fixedly carry thereon the pulleys 112 mentioned hereinbefore, the pulleys being interposed between the upstanding walls 122 and 124. The shaft 126 has fixed on the other end thereof a bevel gear 134 which is in mesh with another bevel gear 136 securely fixed to the output shaft of a reversible motor M fixedly supported on the wall 122 as illustrated in FIG. 4. Therefore, when the motor M is operated, the pulleys 112 will be rotated in mutually opposite directions.

Figure 3:
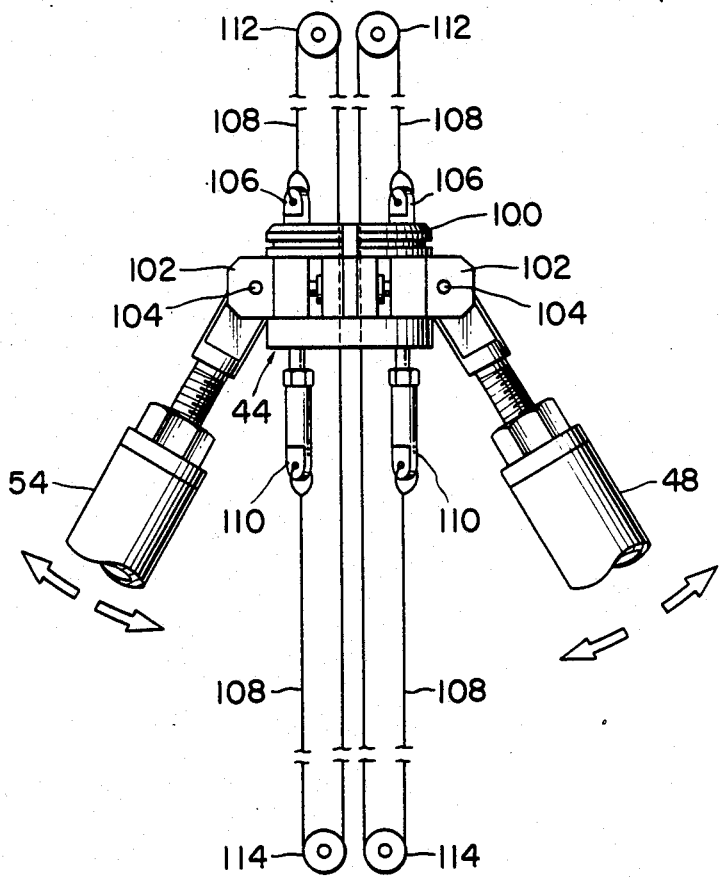
FIG. 3 shows in side elevation a movable hinge assembly and its associated drive means.
Figure 7:
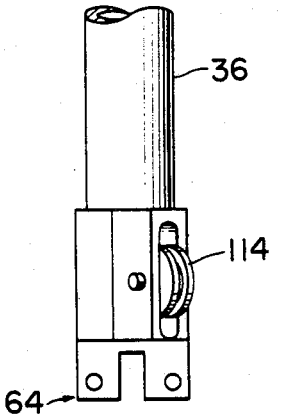
FIG. 7 shows a pulley assembly provided at an end of a cross member and constituting a part of the motor drive means.

The pulleys 114 shown in FIG. 3 are provided at the other end of the first cross member 36 as illustrated in FIG. 7, only one of the pulleys 114 being visible in FIG. 7.

As mentioned before, the wires 108 are passed around the pulleys 112 and 114, as illustrated in FIG. 3, and the spans of the wires 108 between the pulleys 112 and 114 extend in the hollow interior of the first cross member 36, whereby when the motor M is operated in any one of the two directions, the movable hinge assembly 44 will be moved along the first cross member 36 toward or away from the first articulate joint 56.

Figure 8:
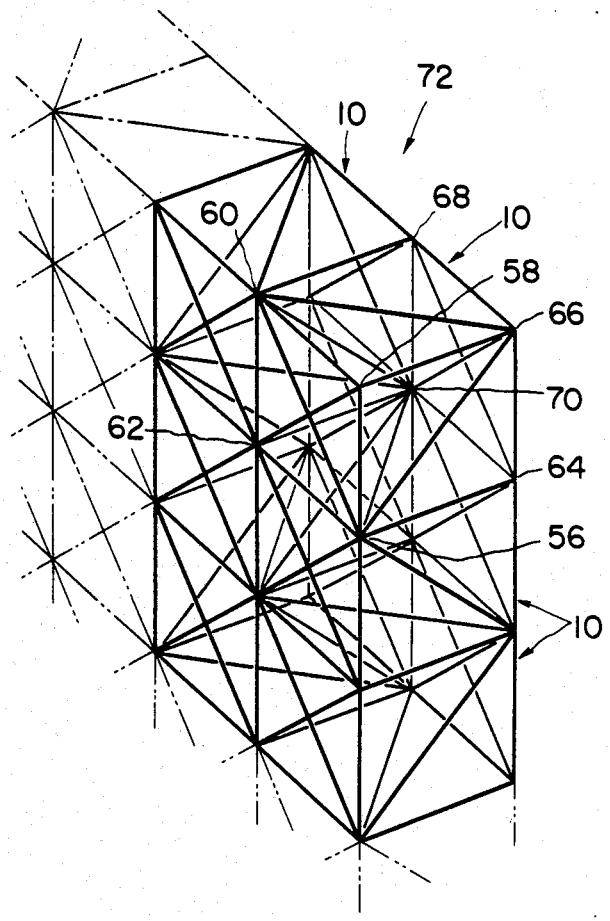
FIG. 8 diagrammatically shows in perspective an example of framework constructed by a planar array of the truss units each constructed as in FIGS. 1 and 2.

In FIG. 8 is shown an example of framework 72 comprising an array of truss units 10, each constructed as above described with reference to FIGS. 1 and 2. As has been stated, the two sets of side members 12 through 18, and 24 through 30, of each truss unit 10 are directed toward the opposite sides of the framework 72. The truss units 10 are so combined that every two adjoining ones share two side members, two cross members, one diagonal member, and the hinge assemblies at the associated joints of these members.

The framework 72 is to be transported into outer space, for example, with the individual truss units 10 folded as shown in FIG. 2. Then, at a place of construction, the framework 72 may be deployed by moving, as by springs or by electric motors or like drive means, the movable hinge assemblies 44 and 46 of the truss units 10 toward the first and third joints 56 and 60, respectively. The construction, or deployment, of the framework 72 will be completed as the movable hinge assemblies are locked in positions. A spring drive is recommended if the framework 72, once deployed, is never to be folded back and unfolded again. However, a motor drive is advantageous in applications where repeated folding and unfolding are expected.

The various rigid members of the truss units 10 may be pivotable each in one direction only if the truss units are to be deployed at one time. As an alternative, however, the truss units 10 may be deployed first in one direction and then in another. A reference back to FIG. 2 will reveal that, for instance, only the first and third ropes 20 and 32 may be tensed while the second and fourth ropes 22 and 34 are held slackened. For such sequential, rather than simultaneous, deployment, the various rigid members of the truss units must be pivotable in multiple directions. Such multiple direction hinge assemblies are per se conventional and so are not shown, it being understood that such simultaneous or sequential deployment of the truss units is a matter of design choice within the scope of this invention.

Figure 9:
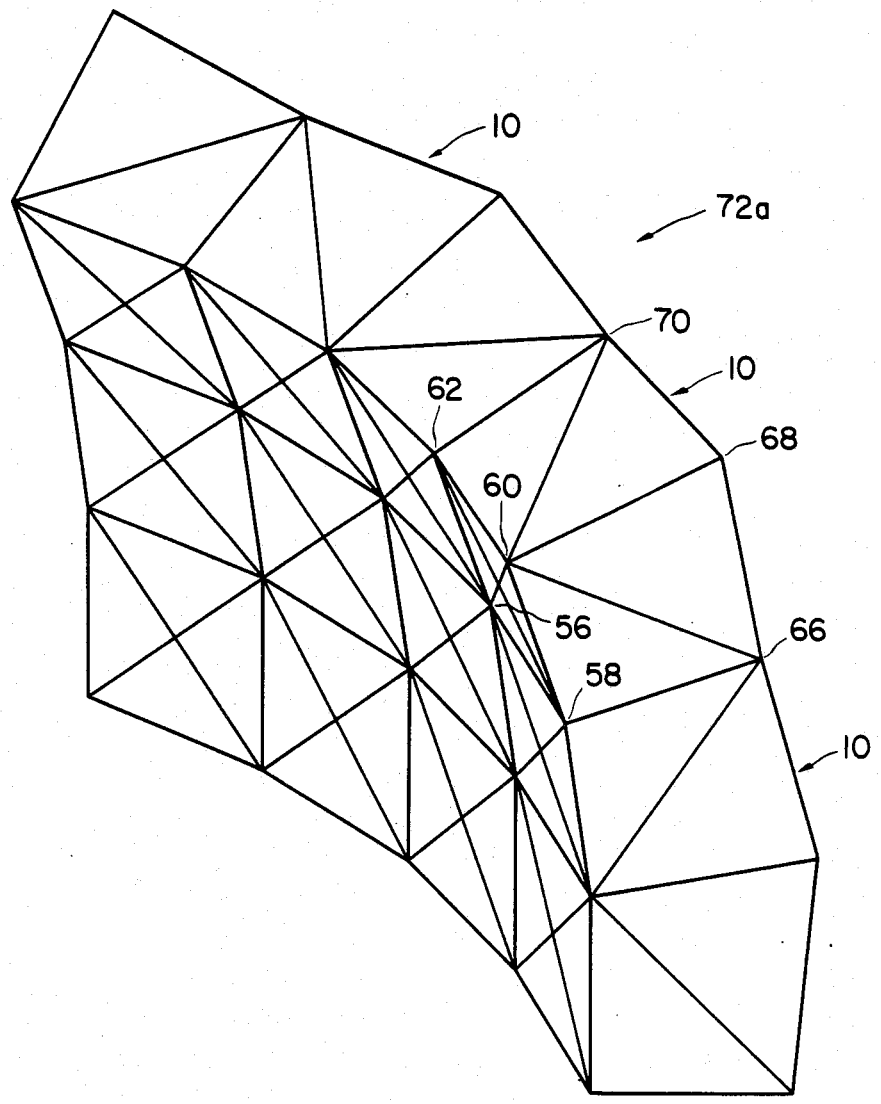
FIG. 9 diagrammatically shows in perspective another example of framework constructed by a curved array of the truss units each constructed substantially as in FIGS. 1 and 2.

FIG. 9 shows the truss units 10 combined in an array as in FIG. 3 but adapted to provide another example of framework 72*a* in the form of a curved wall. A reconsideration of FIGS. 1 and 2 is necessary to understand how the truss unit 10 can be adapted for the construction of the curved framework 72*a*. Let L12, L14, L16, etc., be the lengths of the various rigid members 12, 14, 16, etc., of the truss unit 10. Then the following conditions must be met in order for the truss unit 10 to be collapsed as in FIG. 2:

$$L18+L42=L36+L30$$

$$L12+L38=L36+L24$$

$$L14+L38=L40+L26$$

$$L16+L42=L40+L28$$

$$L12-L18=L14-L16$$

$$L30-L54=L24-L48$$

$$L28-L52=L26-L50$$

The various rigid truss members can take various lengths within the foregoing set of conditions to provide as assortment of frameworks not only in the form of a plane or a straight line but also of a curved surface or curved line. For the construction of the framework 72*a* of FIG. 4, which is curved in two directions, the rectangular arrangement of four side members 24, 26, 28 and 30, for example, may be made longer than the other rectangular arrangement of four side members 12, 14, 16 and 18, and the two cross members 38 and 42, for example, may be made longer than the other two cross members 36 and 40. Further, some of the elongate members, such as members 36, 38, 40 and 42, may not be strictly parallel.

The above explained adaptability of the truss unit in accordance with the invention for the construction of curved structures holds true with all the additional truss units to be presented subsequently. It will therefore be appreciated that the truss units of this invention find application in the construction of large space antennas.

Figure 10:
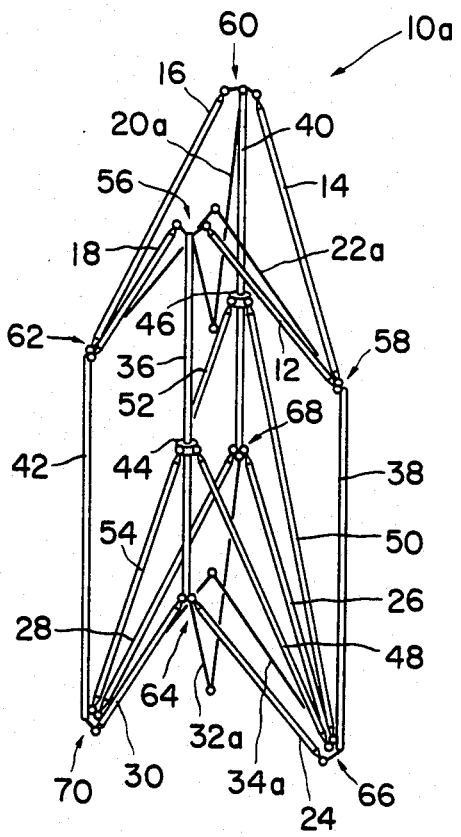
FIG. 10 shows in perspective another preferred form of the truss unit in accordance with the invention, shown in a state of being collapsed.

FIG. 10 is an illustration of a slight modification of the truss unit 10. Shown being collapsed, the modified truss unit 10*a* features rigid, bendable brace members 20*a*, 22*a*, 32*a* and 43*a* employed in substitution for the ropes 20, 22, 32 and 34, respectively, of the truss unit 10. Thus the first rigid brace member 20*a* extends between the joints 56 and 60, the second rigid brace member 22*a* between the joints 58 and 62, the third rigid brace member 32*a* between the joints 64 and 68, and the fourth rigid brace member 43*a* between the joints 66 and 70. Such rigid brace members are indicated by the solid, thick lines in FIG. 10 by way of contradistinction from the other truss members. Each rigid brace member is bendable in the middle, with no locking mechanism being required for holding the member straightened. The bendable brace members can be of slender make as they act only in tension, holding the other truss members in place upon deployment of the truss unit 10*a*.

An advantage of this truss unit 10*a* is the expected longer useful life, in outer space, of the rigid brace members 20*a*, 22*a*, 32*a* and 34*a* than the ropes 20, 22, 32 and 34 of the truss unit 10. As an additional advantage the truss unit 10*a* is free from the possible weakness of the truss unit 10 that the ropes might entangle when loosened, as during the folding or unfolding of the truss unit. Of course, such possible entanglement of the ropes in the FIGS. 1 and 2 embodiment may be obviated by the provision of means for taking up the loosened ropes, although flat strips or bands of any suitable material may be employed in this case in lieu of the ropes. Here again the term "rope" should be construed to comprehend such flat members.

Figure 11:
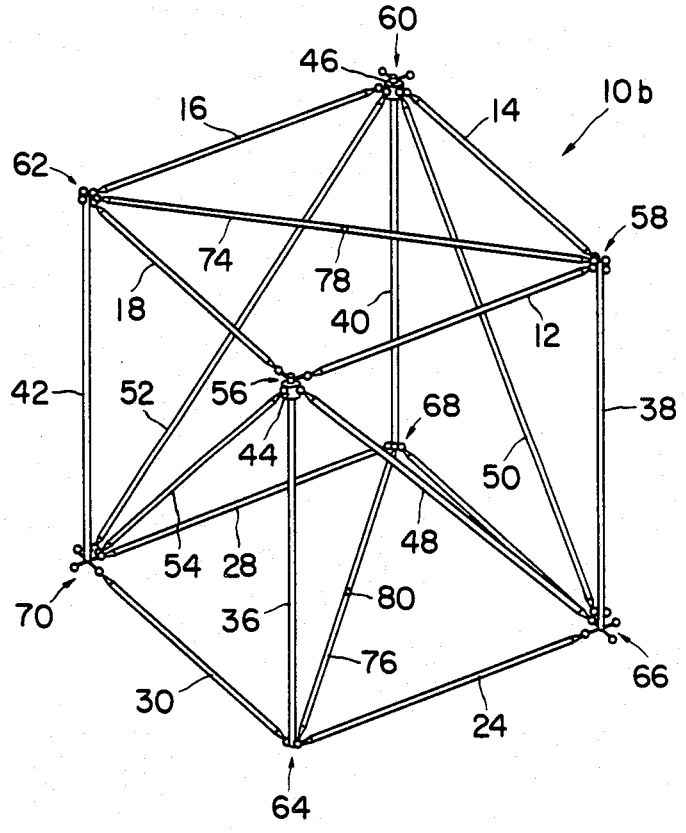
FIG. 11 shows in perspective still another preferred form of the truss unit in accordance with the invention, shown fully deployed.
Figure 12:
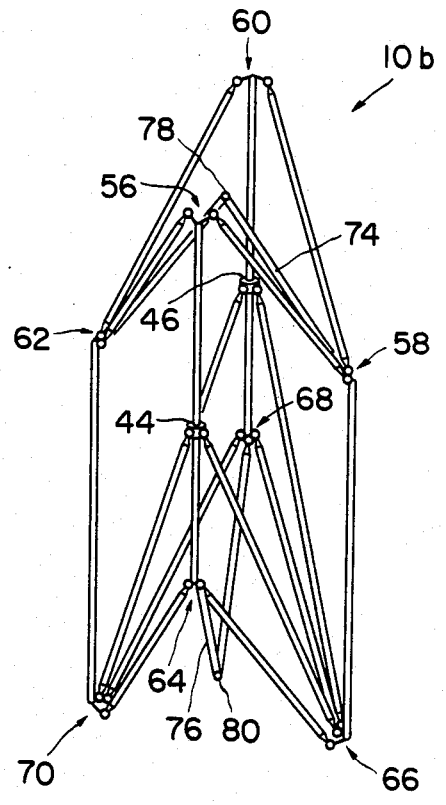
FIG. 12 shows in perspective the truss unit of FIG. 11 being collapsed.

Shown in FIGS. 11 and 12 is another slight modification of the truss unit 10. The second modified truss unit 10*b* has but two rigid, bendable brace members 74 and 76 in place of the two pairs of ropes 20, 22, 32 and 34 of the truss unit 10 or of the two pairs of rigid, bendable brace members 20*a*, 22*a*, 32*a* and 34*a* of the truss unit 10*a*. The first rigid brace member 74 extends between the joints 58 and 62, and the second rigid brace member 76 between the joints 64 and 68, so that they are in crosswise arrangement with respect to each other. The these rigid brace members 74 and 76 are not only bendable at their midpoints 78 and 80, as in FIG. 7, but also are provided with means, not shown, for locking the brace members in their straightened state depicted in FIG. 6. Such lockable articulations 78 and 80 are indicated by the black dots in both FIGS. 6 and 7.

Any framework constructed from a combination of this and other similar truss units 10*b* may be collapsed by first unlocking the articulations 78 and 80 of the brace members 74 and 76. Conversely, upon deployment of the framework, the articulations 78 and 80 may be locked to hold the framework in shape. The other constructional and operational details of this truss unit 10*b* are as set forth above in connection with the foregoing embodiments.

The truss unit 10*b* also gains the advantage of a longer service life than that of the truss unit 10 because of the absence of the ropes or the like. Further the members of this truss unit 10*b* other than the brace members 74 and 76 need not be prestressed like the corresponding members of the truss unit 10.

Figure 13:
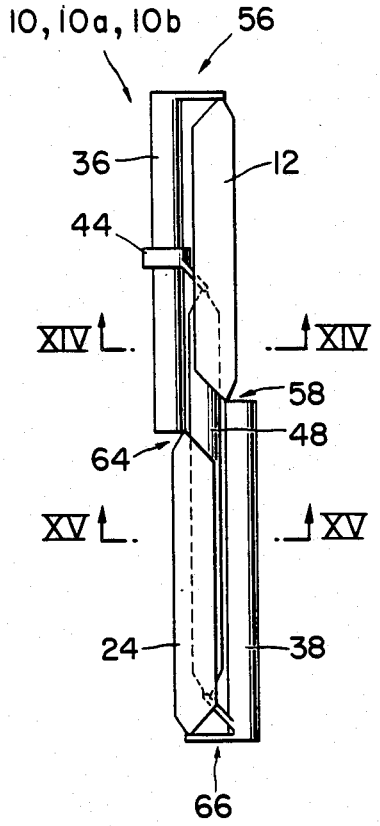
FIG. 13 is an enlarged, partial, somewhat diagrammatic side elevation of the truss unit of any of the foregoing embodiments shown fully collapsed.
Figure 14:
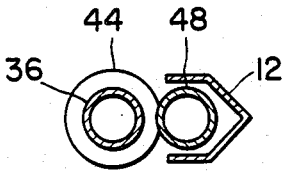
FIG. 14 is a still more enlarged section through the truss unit of FIG. 13, taken along the line XIV—XIV therein.
Figure 15:
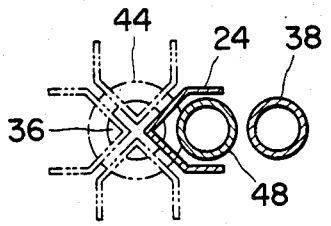
FIG. 15 is also an enlarged section through the truss unit of FIG. 13, taken along the line XV—XV therein.

FIGS. 13, 14 and 15 are explanatory of the preferred cross sectional shapes of the various members of any of the above disclosed truss units 10, 10*a* and 10*b*. Although these figures show only some of the members of the truss unit, it will nevertheless be seen, by referring also to FIGS. 1 and 2, for example, that all the cross members 36, 38, 40 and 41 and all the diagonal members 48, 50, 52 and 54 are of tubular (or solid circular) cross section, whereas the two sets of side members 12, 14, 16 and 18, and 24, 26, 28 and 30, are all of approximately V-shaped cross section. The divergent ends of the V-shaped cross section of each side member are spaced from each other to a greater extent than the diameter of each cross or diagonal member.

Figure 16:
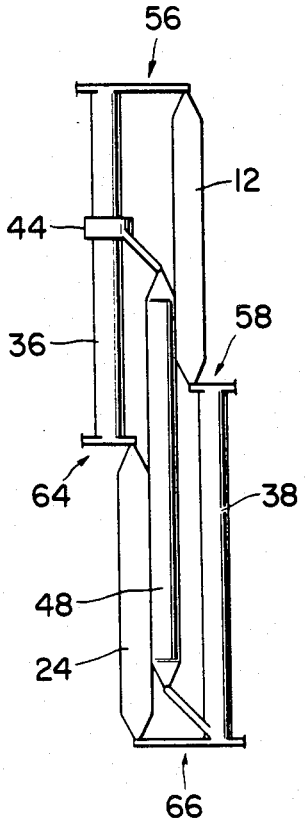
FIG. 16 is a view similar to FIG. 8 but showing a truss unit having members of different cross sectional shape.

Thus, when the truss unit is folded as in FIGS. 13 through 15, the cross and diagonal members of circular cross section are nested in the side members of V-shaped cross section. The thus folded truss unit is far more compact than if, as shown by way of reference in FIG. 16, all the truss members are of circular cross section.

Since many changes could be made in the foregoing disclosed truss units and in the frameworks constructed from such units, and since many different embodiments of this invention could be made without departing from the scope thereof, it is intended that all matter contained in this specification and in the attached drawings shall be interpreted as illustrative and not in a limitative sense.

What is claimed is:

1. A collapsible truss unit for use in combination with other like units to form a desired framework, comprising:

(a) a substantially rectangular arrangement of first, second, third and fourth rigid side members pivotally joined to one another to provide first, second, third and fourth joints;

(b) first flexible brace means arranged diagonally of the substantially rectangular arrangement of the first, second, third and fourth side members;

(c) another substantially rectangular arrangement of fifth, sixth, seventh and eighth rigid side members pivotally joined to one another to provide fifth, sixth, seventh and eighth joints;

(d) second flexible brace means arranged diagonally of the substantially rectangular arrangement of the fifth, sixth, seventh and eighth side members;

(e) first, second, third and fourth rigid cross members extending between, and pivotally joined to, the first and fifth, the second and sixth, the third and seventh, and the fourth and eighth joints, respectively, of the substantially rectangular arrangements of the first to fourth, and the fifth to eighth, side members;

(f) first and second movable hinge assemblies mounted to the first and third cross members, respectively, for movement along the same;

(g) a first rigid diagonal member extending between, and pivotally joined to, the first movable hinge assembly and the sixth joint;

(h) a second rigid diagonal member extending between, and pivotally joined to, the second movable hinge assembly and the sixth joint;

(i) a third rigid diagonal member extending between, and pivotally joined to, the second movable hinge assembly and the eighth joint; and (j) a fourth rigid diagonal member extending between, and pivotally joined to, the first movable hinge assembly and the eighth joint.

2. The collapsible truss unit of claim 1 wherein the first flexible brace means comprises:

(a) a first rope extending between the first and third joints; and (b) a second rope extending between the second and fourth joints;

and wherein the second flexible brace means comprises:

(c) a third rope extending between the fifth and seventh joints; and (d) a fourth rope extending between the sixth and eighth joints.

3. The collapsible truss unit of claim 1 wherein the first flexible brace means comprises:

(a) a first rigid brace member extending between the first and third joints and bendable at a midpoint thereof; and (b) a second rigid brace member extending between the second and fourth joints and bendable at a midpoint thereof;

and wherein the second flexible brace means comprises:

(c) a third rigid brace member extending between the fifth and seventh joints and bendable at a midpoint thereof; and (d) a fourth rigid brace member extending between the sixth and eighth joints and bendable at a midpoint thereof.

4. The collapsible truss unit of claim 1 wherein the first flexible brace means comprises:

(a) a first rigid brace member extending between either of the first and third joints and the second and fourth joints and bendable at a midpoint thereof, the first brace member being capable of being locked in its unbent state and being unlocked for bending;

and wherein the second flexible brace means comprises:

(b) a second rigid brace member extending between either of the fifth and seventh joints and the sixth and eighth joints and bendable at a midpoint thereof, the second brace member being also capable of being locked in its unbent state and being unlocked for bending.

5. The collapsible truss unit of claim 1 wherein the first to eighth side members are all of substantially V-shaped cross section, and the first to fourth cross members and first to fourth diagonal members are all of a cross section capable of being accommodated within the V-shaped cross section, so that the side, cross and diagonal members may be compactly nested together when the truss unit is collapsed.

6. A framework constructed of a plurality or multiplicity of identical collapsible truss units coupled to one another, each truss unit comprising:

(a) a substantially rectangular arrangement of first, second, third and fourth rigid side members pivotally joined to one another to provide first, second, third and fourth joints;

(b) first flexible brace means arranged diagonally of the substantially rectangular arrangement of the first, second, third and fourth side members;

(c) another substantially rectangular arrangement of fifth, sixth, seventh and eighth rigid side members pivotally joined to one another to provide fifth, sixth, seventh and eighth joints;

(d) second flexible brace means arranged diagonally of the substantially rectangular arrangement of the fifth, six, seventh and eighth side members;

(e) first, second, third and fourth rigid cross members extending between, and pivotally joined to, the first and fifth, the second and sixth, the third and seventh, and the fourth and eighth joints, respectively, of the substantially rectangular arrangements of the first to fourth, and the fifth to eighth, side members;

(f) first and second movable hinge assemblies mounted to the first and third cross members, respectively, for movement along the same;

(g) a first rigid diagonal member extending between, and pivotally joined to, the first movable hinge assembly and the sixth joint;

(h) a second rigid diagonal member extending between, and pivotally jointed to, the second movable hinge assembly and the sixth joint;

(i) a third rigid diagonal member extending between, and pivotally joined to, the second movable hinge assembly and the eighth joint; and (j) a fourth rigid diagonal member extending between, and pivotally joined to, the first movable hinge assembly and the eighth joint.

7. The framework of claim 6 wherein the first to fourth side members of each truss unit are directed toward one side of the framework, and wherein the fifth to eighth side members of each truss unit are directed toward the other side of the framework.

8. The framework of claim 7 wherein every two neighboring ones of the truss unit share two side members, two cross members and one diagonal member.

9. The framework of claim 7 wherein the first to fourth side members are each different in length from each of the fifth to eighth side members, and two of the first to fourth cross members are each different in length from each of the other two cross members, whereby the resulting framework is curved in two directions.

10. The framework of claim 6 wherein the truss units are arranged in one plane.

* * * * *